United States Patent [19]

Sturdy

[11] Patent Number: 4,964,276

[45] Date of Patent: Oct. 23, 1990

[54] ENGINE SYNCHRONIZER

[75] Inventor: H. D. Sturdy, Wilmington, N.C.

[73] Assignee: Sturdy Corporation, Wilmington, N.C.

[21] Appl. No.: 336,970

[22] Filed: Apr. 12, 1989

[51] Int. Cl.[5] ..... F01B 21/04

[52] U.S. Cl. ..... 60/700; 60/702

[58] Field of Search ..... 60/700, 702

[56] References Cited

U.S. PATENT DOCUMENTS

| | | | |
|---|---|---|---|
| 3,367,110 | 2/1968 | Leeson, Jr. | 60/702 |
| 3,623,323 | 11/1971 | Fritz | 60/700 |
| 3,986,363 | 10/1976 | Beaman et al. | 60/702 X |
| 4,586,341 | 5/1986 | Kobus | 60/702 X |

*Primary Examiner*—Allen M. Ostrager

*Attorney, Agent, or Firm*—Reising, Ethington, Barnard, Perry & Milton

[57] ABSTRACT

A speed synchronizer for master and slave engines is disclosed. The speed controller of the slave engine is adjustable by a manual actuator and also by a servo actuator. The servo actuator is responsive to a circuit which develops a correction signal corresponding to the difference between engine speed signals. A transfer mechanism selectively transmits movement of either the manual actuator or the servo actuator to the speed controller. The transfer mechanism comprises first and second levers rotationally mounted about a shaft and coupled together for concurrent movement by a spring. The first lever is connected with the manual actuator and the second lever is connected on one side of its rotation shaft to the servo actuator and on the other side of its rotation shaft to the speed controller.

4 Claims, 7 Drawing Sheets

ENGINE SYNCHRONIZER

FIELD OF THE INVENTION

This invention relates to speed control systems for engines; more particularly, it relates to synchronizers for maintaining the speed of an engine in synchronism with another engine or with a master speed setting device.

BACKGROUND OF THE INVENTION

Synchronizers for maintaining the speeds of two or more internal combustion engines in synchronism with each other are well known. Such synchronizers are commonly used in boats having twin propulsion screws driven by twin engines for maintaining the engines at the same operating speed. A mechanical device for synchronizing marine engines is described in the Herbert U.S. Pat. No. 3,258,927 granted July 5, 1966. Electronic synchronizers are described in other prior art patents. In the Beaman et al U.S. Pat. No. 3,986,363 granted Oct. 19, 1976, a synchronizer is described in which a servo is connected to move the sheath of a push-pull cable for throttle adjustment while the throttle lever acts through the wire of the cable for throttle adjustment. A similar arrangement is described in the Stewart U.S. Pat. No. 4,435,961 granted Mar. 13, 1984. In the Kobus U.S. Pat. No. 4,586,341 granted May 6, 1986, the servo motor drives a lead screw and nut which effectively shortens or lengthens the cable wire of a push-pull cable to make throttle adjustments.

There is a need for an improved synchronizer which is self-contained and compact which interfaces with resisting controls.

SUMMARY OF THE INVENTION

In accordance with this invention, a synchronizer is provided for controlling the speed of an engine to maintain it in synchronism with a master speed signal from another engine or from an independent speed signal source. The synchronizer is of low cost and affords a high degree of reliability and maintains the speed synchronism with high accuracy.

Further, in accordance with the invention, the synchronizer comprises master and slave engine speed signal generators, circuit means coupled with the signal generators for producing a correction signal corresponding to the difference between engine speeds, and a servo actuator coupled with the circuit means and movable in response to the correction signal. Transfer means is provided for selectively transmitting movement of a manual actuator or a servo actuator to an adjustable speed control means for adjusting the slave engine speed. Selector means is operative to select which of the actuators transmits movement to the adjustable speed control means.

A complete understanding of this invention may be obtained from the detailed description that follows taken with the accompanying drawings.

BEST MODE FOR CARRYING OUT THE INVENTION

Figure 1:
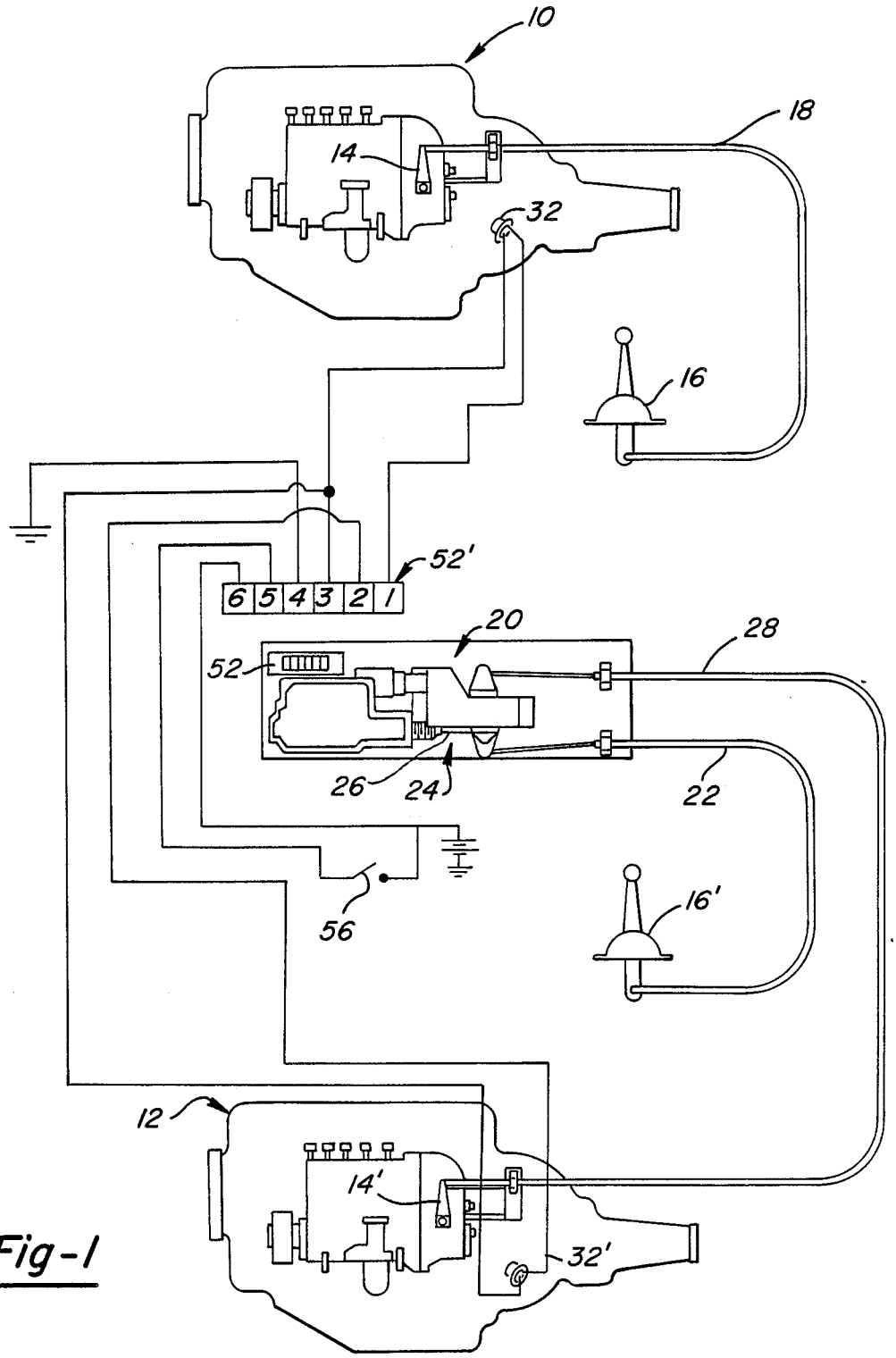
FIG. 1 shows the synchronizer of this invention connected with a master and a slave engine.

Referring now to the drawings, there is shown an illustrative embodiment of the invention in a synchronizer especially adapted for synchronizing the speed of twin marine engines on a boat. It will be appreciated as the description proceeds that the invention is useful in other applications and may be realized in different embodiments.

As shown in FIG. 1, the system comprises, in general, a first engine 10, referred to herein as the "master" engine and a second engine 12, referred to herein as the "slave" engine. Each of the engines drives a separate propeller (not shown). The engines 10 and 12 are provided with speed control by a fuel injector rack having a throttle lever 14 and 14', respectively. The speed of the master engine 10 is adjusted manually by a throttle control lever 16 which is connected through a push-pull cable 18 with the throttle lever 14. The speed of the slave engine 12 is controlled either manually by a throttle control lever 16, or by the synchronizer 20 of this invention. For this purpose, the throttle control lever 16, is connected through a push-pull cable 22 to a cable transfer device 24 and the controller 44 of the synchronizer 20 is connected through a pull rod 26 with the transfer device 24. A push-pull cable 28 is connected between the transfer device 24 and the throttle lever 14, of the slave engine 12. A master engine speed signal is suppled to the synchronizer 20 from a signal generator 32 which is magnetically coupled with the engine flywheel and generates a sinusoidal signal voltage having a frequency proportional to speed. Similarly, the synchronizer 20 is provided with a speed signal from the slave engine 12 by a signal generator 32'. The synchronizer 20 will be described in detail subsequently.

The synchronizer

Figure 2:
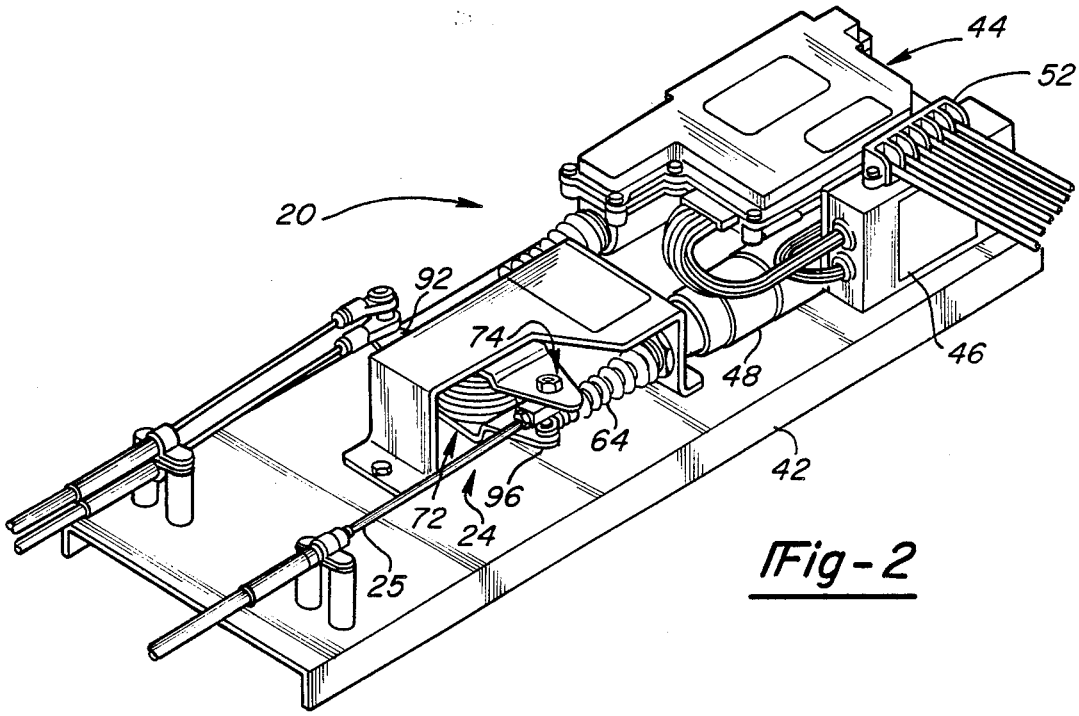
FIG. 2 shows the synchronizer in a perspective view.

The synchronizer 20 will now be described with reference to FIGS. 2, 3, 4 and 5. The synchronizer 20 comprises, in general, a mounting plate 42 which supports the controller 44, a control relay 46, the transfer device 24 and a throttle lever holding solenoid 48. The synchronizer 20 is suitably mounted in the engine compartment of the boat and may be installed in any orientation suitable for connection of the control cables with the engine and the throttle control levers. All of the external electrical connections are made to a terminal strip 52 mounted on the housing of the control relay 46. The terminal strip 52 and the electrical connections to it are shown schematically in FIG. 1 wherein a schematic connector 52' is shown with terminals 1 through 6 corresponding to the six terminals on the terminal strip 52. The master engine speed signal is connected to terminal 1 and speed signal ground is connected to terminal 3. The slave engine speed signal is connected to terminal 2 with the ground thereof connected to terminal 3. Terminal 4 is connected to the system primary ground and terminal 5 is connected to the vehicle battery which provides a continuous source of B+ voltage, suitably of twelve volts. The synchronizer on/off control switch 56 is connected between terminal 6 and ground. As indicated in FIG. 2, the control relay 46 is electrically connected to the solenoid 48 and to the controller 44 by the two bundles of wires shown. The control relay 46 is provided for controlling the energization of the controller 44 and for supplying certain control signals thereto for the start-up and shut-down of the synchronizer 20. The controller 44 comprises an electronically controlled servo with a linear actuator 112 which is connected to the transfer device by a pull rod 26. The controller 44 is responsive to the master engine speed signal, the slave engine speed signal and certain input signals from the time delay relay 46 for controlling the position of the linear actuator 112 when the synchronizer 20 is engaged. The circuitry of the time delay relay 46 and that of the controller 44 will be described in more detail subsequently. It is noted that the solenoid 48 is mounted on the end wall of the support bracket 62 of the transfer device 24. The armature 64 of the solenoid 48 is connected with the transfer device 24. The transfer device 24 will be described presently.

Figure 3:
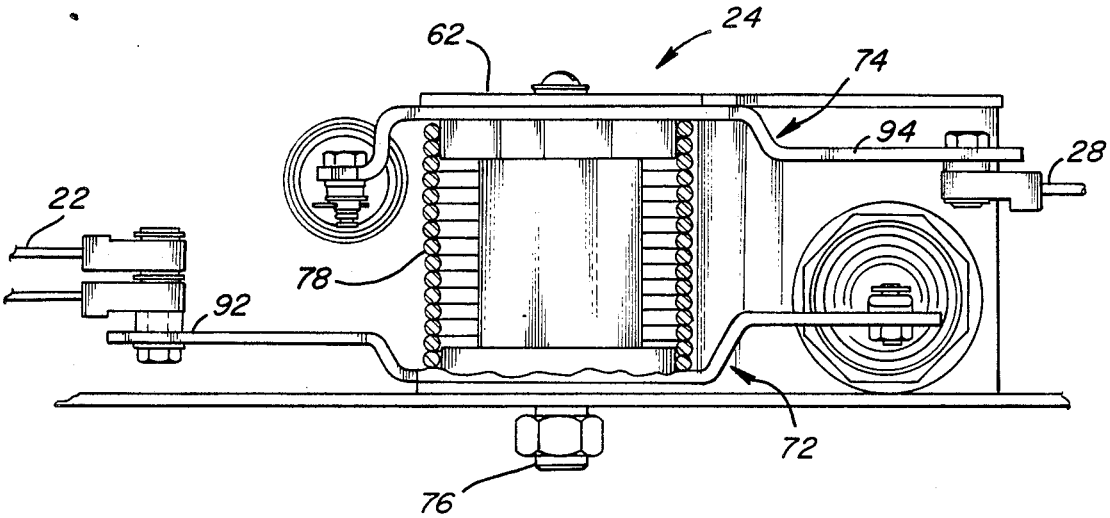
FIG. 3 shows the transfer device of the synchronizer.
Figure 4:
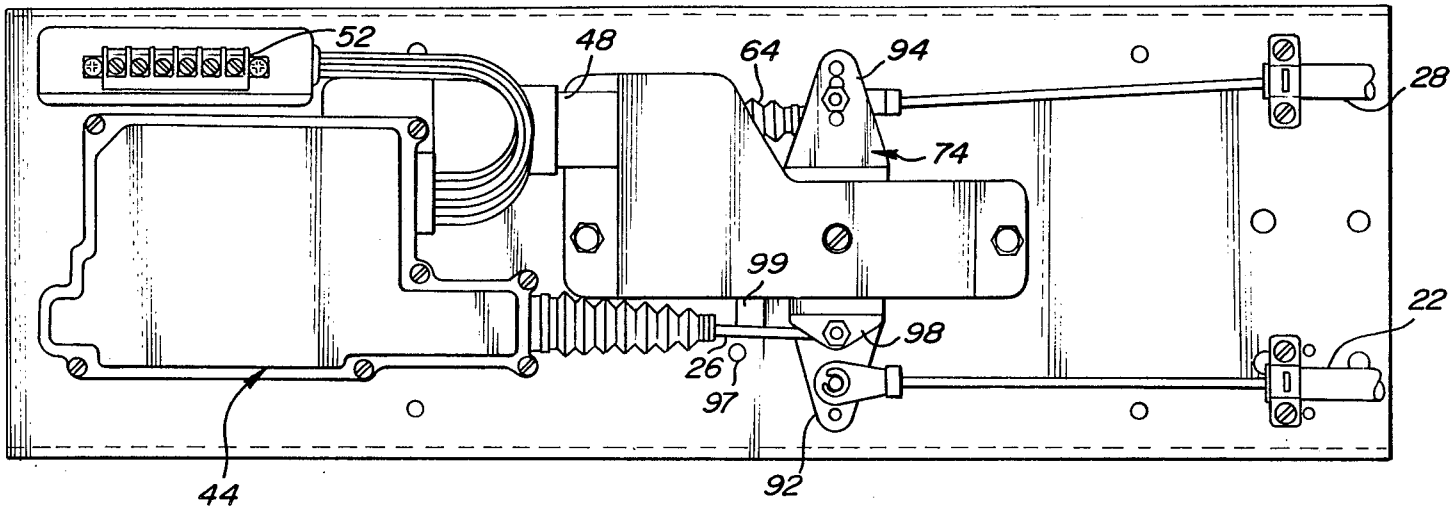
FIG. 4 shows a plan view of the synchronizer.
Figure 5:
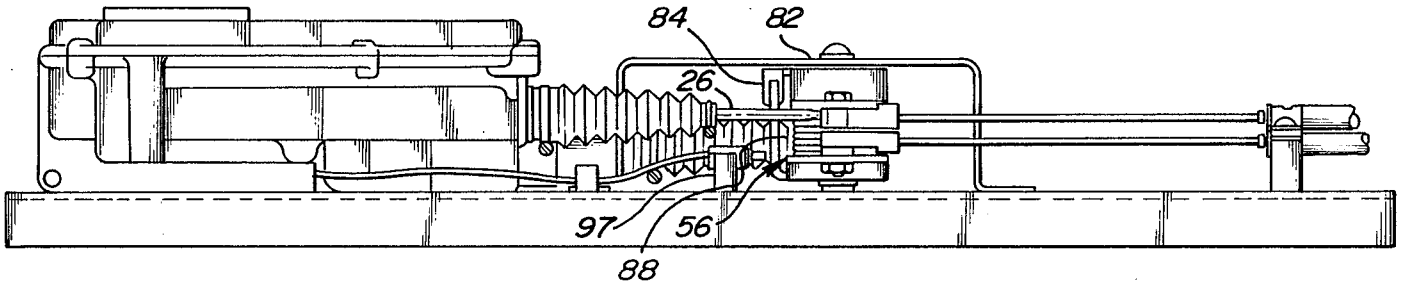
FIG. 5 shows a side elevation of the synchronizer.

The transfer device 24 comprises a manual control lever 72 and a servo control lever 74 both of which are pivotally mounted on a pivot shaft 76. The pivot shaft is fixedly mounted at its lower end in the mounting plate 42 and is fixedly mounted at its upper end in the support bracket 62. A torsional coil spring 78 has its upper end 82 held against movement by a down-turned flange 84 on the servo control lever 74, as best shown in FIG. 5. The coil spring 78 has its lower end 86 held by engagement with an up-turned flange 88 on the manual control lever 72, as best shown in FIG. 5. The down-turned flange 84 and the up-turned flange 88 are held in abutting engagement with each other by the tension in the torsion coil spring 78, as best shown in FIG. 5. In this arrangement, the servo control lever 74 can be rotated against the torsional resistance of the spring 78 in the clockwise direction only, as viewed from the top in FIGS. 2, 3 and 4 provided that the manual control lever 72 is held fast. Also, the manual control lever is rotatable in a counterclockwise direction against the resistance of spring 78, assuming that the servo control lever 74 is held fast. One end 92 of the manual control lever 72 is connected by the push-pull cable 22 with the throttle control lever 16'. One end 94 of the servo control lever 74 is connected through the push-pull cable 28 with the throttle lever 14' on the slave engine 12. Thus, unless the manual control lever 72 is restrained from movement about the pivot shaft 76, the transfer device 24 is adapted to transmit motion of the throttle control lever 16' to the throttle lever 14' through the manual control lever 72, the coil spring 78 and the servo control lever 74. In this manner, manual control is provided for the slave engine throttle when the synchronizer 20 is not engaged. When the synchronizer 20 is to be shut down or disengaged, the operator must pull the slave engine throttle lever 16' to the close throttle position. In this position, the manual control lever 72 engages a stop pin 97 and it actuates a close throttle signal switch 99, as will be described subsequently.

For exercising speed control over the slave engine 12 through the synchronizer 20, additional connections are made to the transfer device 24 as will now be described. The solenoid 48 has its armature 64 connected directly to the other end 96 of the manual control lever 72, as best shown in FIG. 2. When solenoid 48 is energized, the armature 64 is retracted and the end 96 of the manual control lever 72 is held in a retracted position against the opposing force developed by the coil spring 78. Thus, when the solenoid 48 is energized the manual control lever 72 is retracted and effectively immobilized in the retracted position. In this condition, the speed of the slave engine 12 is controlled by movement of the servo control lever 74. For this purpose, the other end 98 of the servo control lever, as best shown in FIG. 4, is connected by the pull rod 26 with the linear actuator 112 of the servo motor. The controller 44 and the servo with the linear actuator 112 will be described in greater detail subsequently.

The Controller Servo

Figure 6:
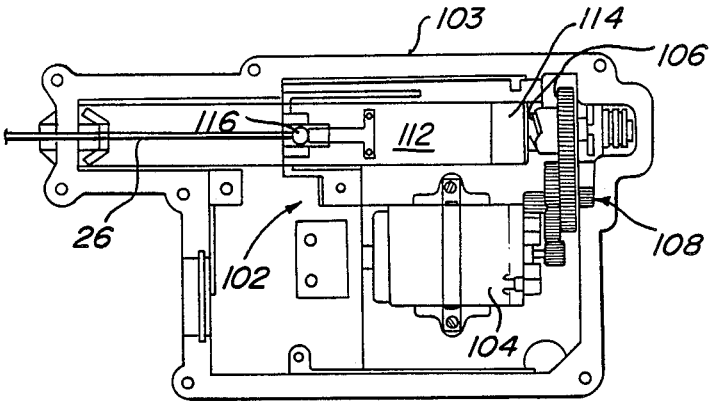
FIG. 6 shows the servo of the synchronizer.
Figure 7:
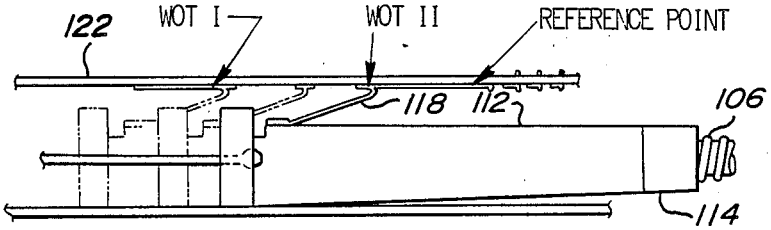
FIG. 7 shows the linear actuator.
Figure 8:
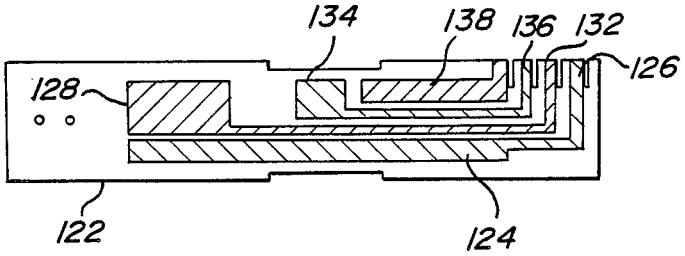
FIG. 8 shows a switch plate of the servo.

The controller 44, as shown in FIGS. 6, 7 and 8, comprises a servo 102 including the linear actuator 112. The servo 102 is shown in FIG. 6 in the housing 103 of the controller 44 with the cover removed. (The controller also includes a controller circuit which is mounted in the housing 103 but not shown in FIG. 6. The controller circuit will be described with reference to FIG. 10.) The servo comprises a reversible electric motor 104 which is a DC permanent magnet motor. The linear actuator 58 comprises a lead screw 106 which is mounted for rotation in the housing. The motor 104 is drivingly connected with the lead screw 106 through a gear train 108.

The linear actuator 112 is mounted on the lead screw by a drive nut 114 which is nonrotatively secured to the actuator member. The outer end of the actuator 112 is provided with a connector 115 which receives a ball end 116 of the pull rod 26. A bridging contact 118 is mounted on the actuator 112 and coacts with a switch plate 122. In this arrangement, rotation of the motor 104 in a clockwise direction (viewed from the pinion gear end) causes the lead screw to rotate in the clockwise direction and advance the drive nut 114 and hence the actuator 112 to the right (as viewed in FIG. 6), thus retracting the rod 26 into the housing. When the motor is rotated in the counterclockwise direction, the actuator 112 is moved to the left (as viewed in FIG. 6) and the rod is extended, i.e. pulled out of the housing by the spring of the engine throttle lever (not shown).

The switch plate 122 as shown in FIGS. 7 and 8 is a printed circuit with a set of conductive paths adjacent the linear actuator 112. As shown in FIG. 8, the switch plate comprises an elongated ground contact 124 having a terminal 126. It also comprises a wide open throttle contact, herein called wot-1 contact 128 having a terminal 132. The switch plate also includes an intermediate contact, herein called a wot-2 contact 134 having a terminal 136 and a reference contact 138 having a terminal 142. The bridging contact 118 is adapted to bridge between the ground contact 124 and the wot-1 contact 128, the wot-2 contact 134 and the reference contact 138 as the actuator 112 is moved axially by the lead screw.

The Control Relay

Figure 9:
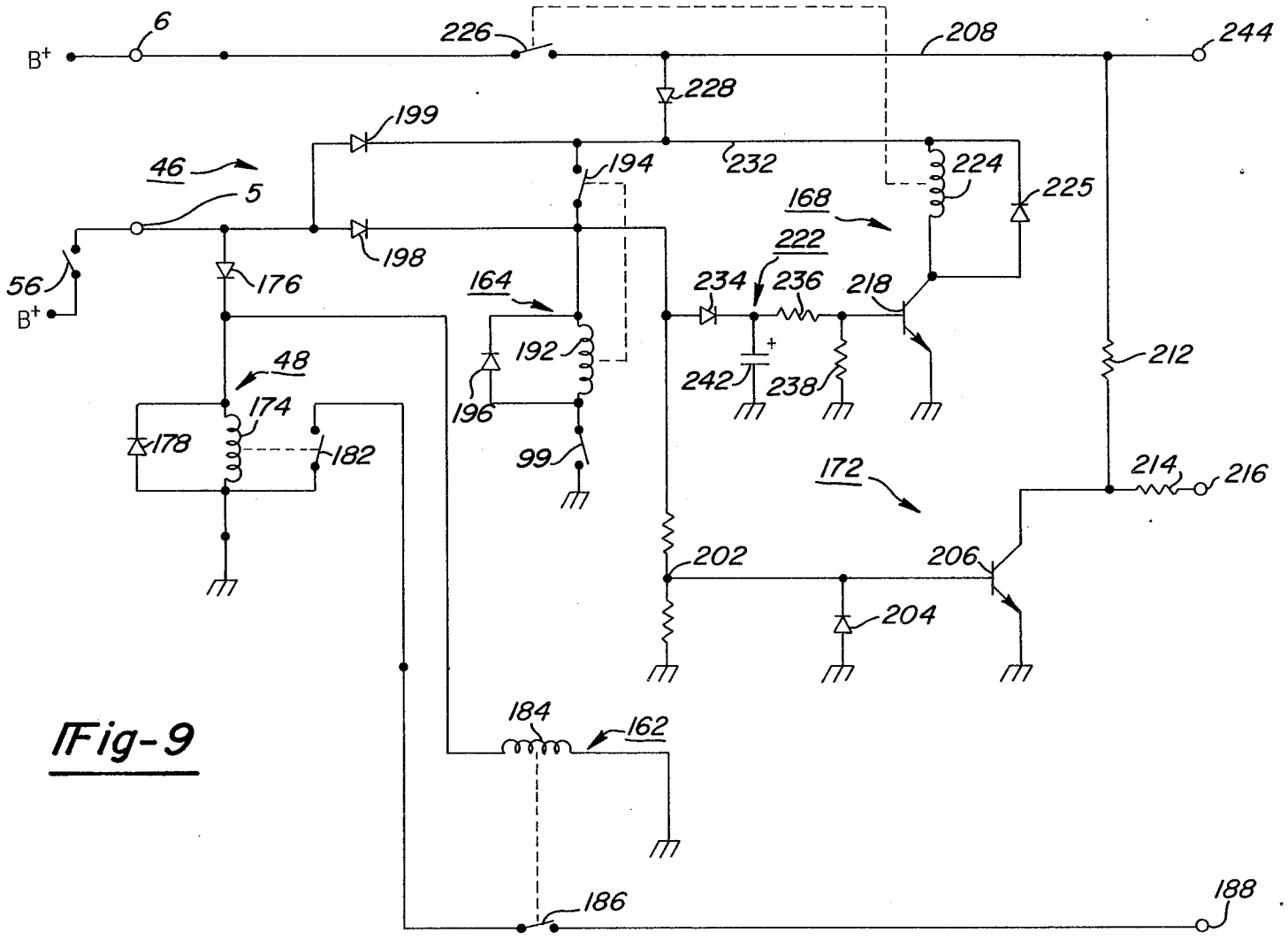
FIG. 9 is a schematic diagram of the control relay.

The control relay 46 is shown schematically in FIG. 9. As previously mentioned, the time delay relay controls the energization of the controller 44 and also provides it with certain control signals. For this purpose, the synchronizer on/off switch 56 is adapted to apply the B+ supply voltage to an input terminal 5 of the time delay relay 46. Another input terminal 6 is connected directly to the B+ supply voltage. (The other input terminals of the time delay relay 46 which were described with reference to FIG. 1 are not shown in FIG. 9; these inputs are merely passed directly through the time delay relay housing to the controller 44.) The time delay relay 46 comprises, in general, the holding solenoid 48 and a switching relay 162. A latching relay 164 latches a power supply connection to the controller 44 and is connected through the close throttle signal switch 99. A time delay relay circuit 168 functions to maintain power supply to the controller 44 for a predetermined time interval after the close throttle signal switch 99 is opened. An engage signal circuit 172 develops an engage command signal for the controller 44 when the on/off switch is turned on.

The holding solenoid 48 for the manual control lever 72 is energized through the on/off switch 56 and is connected between input terminal 164 and ground. The solenoid winding 174 is connected in series with a diode 176 between the terminal 5 and ground. A protective diode 178 is connected across the winding 174. A normally open, solenoid actuated switch 182 is closed when the solenoid pulls in and is utilized for signalling this condition to the controller 44. To prevent false signalling of the solenoid pulled in condition under certain circumstances, the switching relay 162 is provided. The relay winding 184 is connected in parallel with the relay winding 174 and is energized when the on/off switch 56 is turned on. A normally open relay contact 186 is actuated to the closed position when the winding 184 is energized. The contacts 182 and 186 are connected in series between ground at the solenoid winding 174 and develops a solenoid switch signal on an output terminal 188 which is coupled to an input of the controller 44, as will be described subsequently.

A latching relay 164 comprises a relay winding 192 and a switching contact 194 actuated by the winding. A protective diode 196 is connected across the winding 194 The relay winding 192 is energized by closing the on/off switch 56 which supplies power to the winding through a blocking diode 198 to the upper end of the winding 192. The lower end of the winding is connected to ground through the normally closed throttle signal switch 99. When the relay winding 192 is energized, the switch contacts 194 are closed.

When the switch contacts 194 are closed by the relay winding 192, B+ voltage is supplied through the diode 198 to the engage signal circuit 172. This includes a voltage divider 202 which supplies an input voltage across the diode 204 to the base of a transistor 206. The transistor 206 has its emitter connected to ground and its collector connected to the B+ voltage line 208 through a resistor 212. The collector 206 is connected through a resistor 214 to the engage signal output terminal 216. When the transistor 206 is switched on, a logic low engage signal is developed on terminal 216.

The time delay relay circuit 168 comprises, in general, a transistor 218 having a time constant input circuit 222 and a relay including a relay coil 224 and relay contacts 226. When switch 56 is closed, B+ supply voltage is applied through diode 199 to the winding 224. The relay contacts 226 are normally open and when the relay coil 224 is energized, the contacts close and apply B+ supply voltage from the terminal 6 through the blocking diode 228 to the voltage supply conductor 232. A protective diode 225 is connected in parallel with the coil 224. The time constant circuit 222 is adapted to allow fast turn on of the switching transistor 218 and to provide for a time delayed turn off. For this purpose, the B+ supply voltage is applied through the on/off switch 56, diode 198, diode 234, resistor 236 and across the voltage divider resistor 238 to the base of the transistor 218. A capacitor 242 is connected between the junction of diode 234 and resistor 236 to ground. When the on/off switch 56 is opened, the time constant discharge circuit including the capacitor 242 and resistors 236 and 238 maintains a sufficient voltage on the base of transistor 218 to hold it in the conductive state for a predetermined time delay interval, say about two seconds. Thus, after the on/off switch 56 is open, the switch contacts 226 will remain closed for the time delay. This supplies B+ voltage to the output terminal 244 during the time period and than it is interrupted. The output terminal 244 supplies B+ voltage to the controller 44, as will be discussed subsequently.

The Controller Circuit

Figure 10:
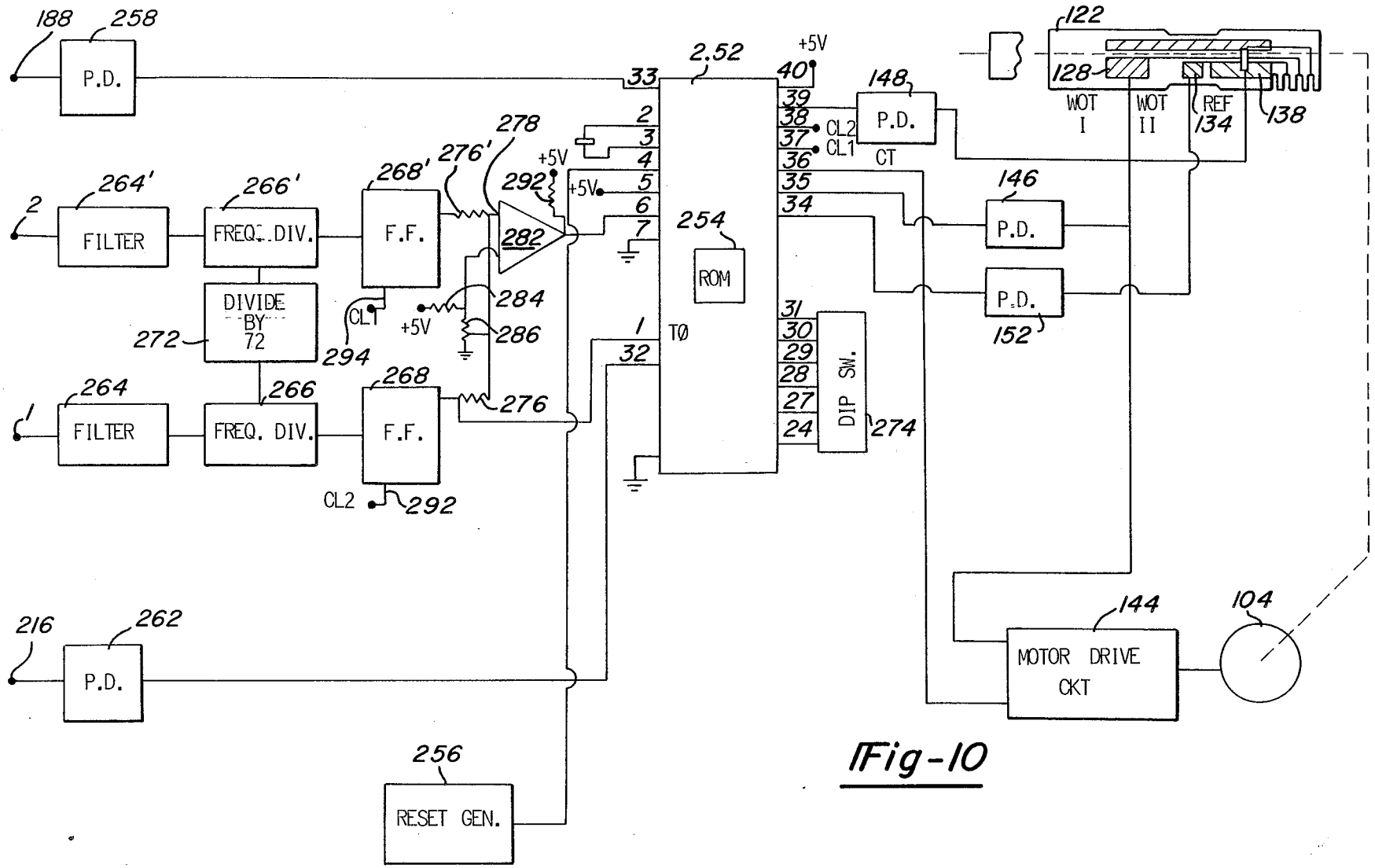
FIG. 10 is a diagram of the controller circuit.

The circuit of the controller 44 is shown in FIG. 10. It comprises a microprocessor 252 which is an integrated circuit chip with a self contained read only memory (ROM) 254 for storing the operation program of the microprocessor. It is a conventional integrated circuit chip, sometimes called a single chip processor, and is of the type number 80C49 available from Intel Corporation. The supply voltage for the microprocessor is connected with pin 40 and the pins 20 and 7 are connected to ground. The microprocessor is provided with a clock input at pins 2 and 3 to establish the operating frequency. A reset generator 256 is connected with the reset input at pin 4 to ensure that the microprocessor is reset on power up or in the event that the supply voltage falls below a predetermined level. The signal inputs to the microprocessor will now be described.

The solenoid switch signal from terminal 188 of the relay circuit 46 is applied through a pull-down circuit 258 to the pin 33 of the microprocessor. The engage signal from the output terminal 216 of the relay circuit is applied through a pull-down circuit 262 to the pin 32 of the microprocessor.

The microprocessor 252 is programmed to compare the measured speed of the slave engine 12 with the measured speed of the master engine 10 and to develop control signals for changing the slave engine speed to synchronize it with the master engine speed. The master engine speed signal is a sinusoidal waveform as developed by the generator 32 and is applied through terminal 1 to the input of a filter circuit 264 which produces a train of square wave pulses. The output of the filter circuit 264 is applied to the input of a frequency dividing circuit 266 and the output thereof is applied to the input of a flip-flop 268. In a similar manner, the slave engine speed signal which is derived from the generator 32′ on terminal 2 is processed by the filter circuit 264′, the frequency divider 266′ and the flip-flop 268′. The frequency division effected by the frequency dividers 266 and 266′ is established by the setting of selector switches in the divide-by-n circuit 272. The divisor may be any power of two from one to four in order to reduce the frequency output of the dividers to a suitable value for processing by the microprocessor. The microprocessor includes programmable inputs in the form of dip switches 272 which are connected with pins 24 and 27 through 31. These programmable inputs are set in accordance with the value of the divisor selected by the circuit 272 so that the circuitry is calibrated for a appropriate number of pulses per revolution of the engines.

The output of flip-flop 268 is applied through a resistor 276 to one input 278 of a comparator 282. Similarly, the output of the flip-flop 268' is applied through a resistor 276' to the input 278 of the comparator 282. A voltage divider including resistors 284 and 286 supplies a reference voltage to the other input 288 of the comparator 282. The output of the comparator 288 is connected through a pull-up resistor 292 with the five volt supply voltage and it is also connected to the interrupt input on pin 6 of the microprocessor 252. The output of flip-flop 268 goes to logic high in response to a positive going pulse at its input and the output stays at the logic high level until a reset pulse is applied to the clear input 292 of the flip-flop. Similarly, the output of flip-flop 268' responds to a positive going pulse at its input by producing a logic high at its output which remains high until the flip-flop receives a clear pulse at its clear input 294. The output of flip-flop 268 is applied to the T0 input at pin 1 of the microprocessor 252 for the purpose of distinguishing the sources of the interrupt signals applied to the pin 6 by the comparator 282. The output of the comparator 282 goes to logic low in response to a logic high on the output of either flip-flop 268 or 268', providing that the output exceeds the voltage level of the reference voltage at the input 288. Such an interrupt signal at pin 6 of the microprocessor causes it to produce a clear signal on either pin 37 which is connected with the clear input 294 of flip-flop 268' or on the pin 38 which is connected with the clear input 292 of flip-flop 268, as will be described below.

When pin 6 receives an interrupt pulse and there is not a coincident pulse at pin 1, the microprocessor recognizes that the interrupt pulse was initiated by the output of the flip-flop 268' due to the speed signal of the slave engine. The microprocessor then measures the time interval between that interrupt pulse and the succeeding interrupt pulse which is attributed to the speed signal of the slave engine and memorizes that time interval as an indication of the speed of the slave engine. That time interval is inversely proportional to speed. On the other hand, when pin 6 receives an interrupt pulse and there is a coincident pulse at pin 1, the microprocessor recognizes flip-flop 268 as the source of the interrupt pulse. The microprocessor then measures the time interval between the occurrence of that interrupt pulse and the next such pulse from flip-flop 268 and memorizes that time interval as an indication of the speed of the master engine. If the time interval for the slave engine is greater than that of the master engine, the slave engine speed is less than the master engine speed and the microprocessor produces an open throttle signal WOT on output pin 35. On the other hand, if the time interval for the slave engine is less than for the master engine, the slave engine is running too fast and the microprocessor produces a close throttle signal CT on pin 36.

When the output pulses from the flip-flops 268 and 268' coincide with each other the comparator 282 will produce an interrupt pulse at pin 6 just the same as if either one, of the flip-flops had produced the interrupt signal. The microprocessor first interprets this occurrence as being a result of an output signal from flip-flop 268 because of the coincidence of a signal on pin 1. Accordingly, the microprocessor produces a clear signal on pin 38 and the output of flip-flop 268 is reset to logic low. This, however, does not effect the output of flip-flop 268' which remains at logic high and the interrupt signal at pin 6 is not removed. The microprocessor interprets this to mean that the two flip-flops produced output pulses at the same time. It then measures the time interval from that interrupt signal until the next. If the next interrupt signal is attributed to the slave engine and the next interrupt pulse after is attributed to the master engine, or vice versa, the respective time intervals will be taken as the respective engine speeds. If two successive interrupt pulses are attributed to coincident pulses at the outputs of the flip-flops 268 and 268', the microprocessor will interpret that to mean both engines are operating at the same speed, i.e. they are in synchronism.

The open throttle signal WOT and the close throttle signal CT developed by the microprocessor 252 at pins 35 and 36 respectively are utilized for controlling the speed and direction of the motor 104. For this purpose, the pin 36 of the microprocessor is connected to the close throttle input of a motor drive circuit 144 which controls the energization of the reversible DC motor 104. Pin 35 is coupled through a pull-down circuit 146 to the open throttle input of the motor drive circuit 144. The motor 104, as described above, is coupled through a gear train with the linear actuator 112 which carries the movable bridging contact 118 for coaction with the switch plate 122. The switch plate contacts are adapted to supply certain input signals to the microprocessor for indicating the position of the actuator member 112 and hence, the position of the throttle lever on the slave engine. This is utilized by the microprocessor for setting the drive speed for the motor 104. For this purpose, the reference contact 138 on the switch plate is connected through a pull-down circuit 148 to pin 39 on the microprocessor. The wot-1 contact 128 of the switch plate is connected directly to the open throttle input of the motor drive circuit 144. The wot-2 contact 134 is connected through a pull-down circuit 152 to pin 34 of the microprocessor.

The microprocessor, under program control, causes the WOT signal at pin 35 to go to logic low when program execution calls for moving the actuator member 112 toward the wide open throttle position. Thus, when the WOT signal is low, the motor is to be energized for rotation in the counterclockwise direction. The microprocessor causes the close throttle signal at pin 36 to go to logic low when program execution calls for the actuator 112 to be moved toward the close throttle position. The microprocessor is also programmed to produce WOT signals at pin 35 and CT signals at pin 36 which will energize the motor at selectively different speeds according to different operating conditions. Speed control is provided by pulse width modulation of the motor control signals, WOT and CT, in the microprocessor. Low speed, as desired for certain operating conditions is obtained by causing the microprocessor to produce a modulated WOT signal or a modulated CT signal. There are operating conditions in which full speed motor operation is desired and this is obtained by causing the microprocessor to produce an unmodulated WOT signal on pin 35 or an unmodulated CT signal on pin 36. Whether the motor is operated at high speed or low speed is dependent in part upon which of the switch plate contacts 128, 134, or 138 is engaged by the bridging contact 118 and in part by the speed error of the slave engine as determined by the microprocessor.

Operation of System

The synchronizer 20 operates as follows. When the operator wants to engage the synchronizer 20, both of the throttle levers 16 and 16' are set to the idle position, the on/off switch 56 is turned on and the slave throttle lever 16' is pushed to maximum speed position. The synchronizer is now in control of the slave engine and the lever 16' is ineffective. The speed of both engines is controlled by the master throttle lever 16.

When the synchronizer 20 is engaged, as just described, the operating condition is as follows. The holding solenoid 48 is energized and the manual control lever 72 is held in the full throttle position by the solenoid. This closes the switch contacts 182; at the same time the switching relay 162 is energized and the contacts 186 are closed. Accordingly, the output terminal 188 goes to logic low or ground and this signal is applied to the controller 44 to enable modulated control of the servo 102. At the same time, the B+ voltage is applied to the engage signal circuit 172 and the output terminal 216 is held at logic low and this signal is applied to the controller 44 and causes it to energize the servo 102 to go to close throttle position. At the same time, the B+ supply voltage is applied to the input of the time delay relay circuit 168. This turns the transistor 218 on and energizes the relay coil 224. Accordingly, the switch contacts 226 are closed and the B+ supply voltage is applied through the supply line 208 to the B+ supply terminal 244 for supplying the voltage to the controller 44. With the manual control lever 72 moved away from the closed throttle position, the close throttle switch 99 is closed. The latching relay 164 is initially energized from the B+ supply through the on/off switch 56 and this closes relay contacts 194. A holding current is supplied from the supply terminal 6 through switch contacts 226, diode 228 and the switch contacts 194 of the latching relay.

In the above-described condition of the control relay 46, the synchronizer 20 is in control of the slave engine and the operator adjusts speed as desired by setting the master throttle lever 16. The controller 44 is operative to maintain the slave engine speed in synchronism with the master engine. The microprocessor 252, as described above, compares the measured speed of the slave engine with the measured speed of the master engine and produces the appropriate speed control signal for the slave engine as either a open throttle signal WOT on pin 35 or a close throttle signal CT on pin 36. If the slave engine speed is below that of the master engine, the WOT signal is developed and applied to the motor drive circuit 144. If the slave engine speed is higher than that of the master engine, the CT signal is developed and applied to the motor drive circuit 144. The motor 104 is energized in the open throttle or close throttle direction, corresponding to the signal developed by the microprocessor, and the servo 102 adjusts the throttle lever of the slave engine so that the speed is adjusted toward synchronism with the master engine. The speed of rotation of motor 104, and hence the speed of movement of the linear actuator 122 is controlled programmatically by the microprocessor 252 as described above. In this manner, the speed of the slave engine is controlled so that it is accurately equal to the speed of the master engine.

To disengage the synchronizer 20, both the master and slave throttle levers 16 and 16' are moved to the idle position and the on/off switch 56 is turned off. When the switch 56 is turned off, the solenoid winding 174 is deenergized and releases the manual control lever 72 of the synchronizer. This allows the switch contacts 182 to open and at the same time, the switching relay 184 is deenergized and the relay contacts 186 are opened and disconnects the terminal 188 from ground. This solenoid switch signal is applied to microprocessor 252 which causes the servo to be driven to the close throttle position. When the slave throttle lever 16' is moved to the idle position, or close throttle, the close throttle signal switch 99 is opened. (Depending upon frictional resistance, the throttle lever 16' may be moved to the idle position by the servo.) When switch 99 is opened, the latching relay winding 192 is deenergized. Accordingly, the relay contacts 194 are opened. This removes the supply voltage from the input of the engage signal circuit 172 and the transistor 206 is turned off. This causes the engage signal output terminal 216 to go to logic high. When relay contacts 194 open, the supply voltage is also removed from the input of the time constant circuit 222; however, because of the time delay discharge of capacitor 242 the transistor 218 remains turned on for about two seconds. Thus, the relay coil 224 remains energized for this time period and the relay contacts 226 remain closed. Accordingly, during the time delay period the B+ supply voltage remains on the supply voltage terminal 244 for the controller 44. During this shut down sequence, the engage signal goes from logic low to high when the close throttle signal switch 99 reopens. This causes the microprocessor to energize the servo to move the linear actuator 112 to the wide open throttle position. The time delay provided by the circuit 168 is sufficient for the servo to move the linear actuator 26 and the servo control lever 74 to the wide open throttle position so that it does not interfere with manual control of the slave engine throttle through the manual control lever 72 over the full range of throttle movement.

Figure 11:
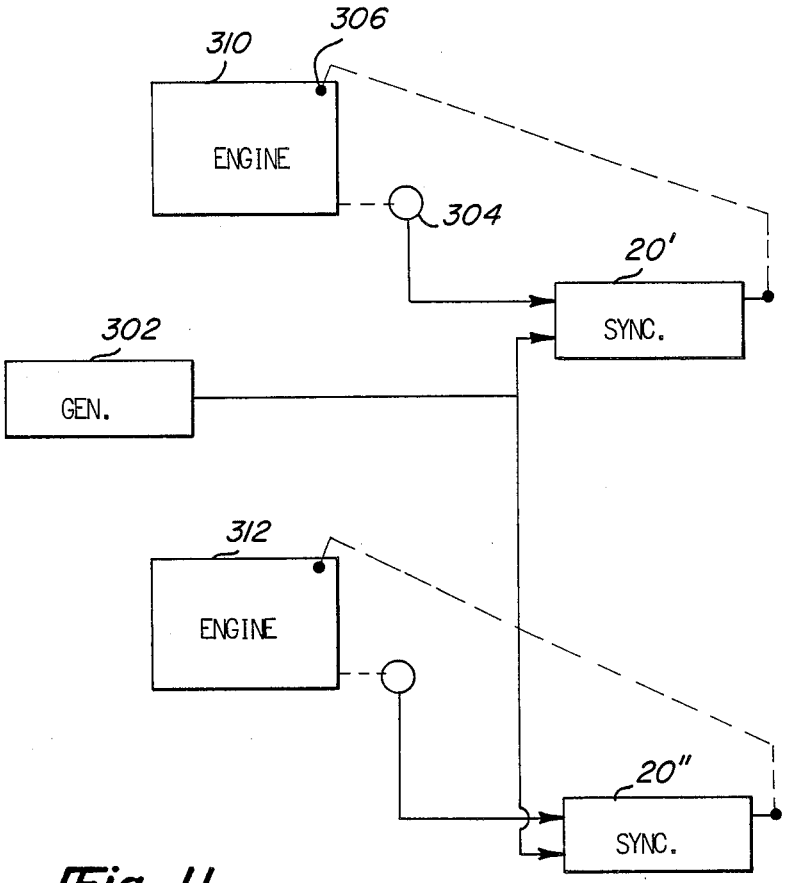
FIG. 11 shows the synchronizer operating with a speed signal source independent of the engines being controlled.

In the illustrative embodiment of the invention described above, the synchronizer 20 is utilized to control the speed of the slave engine so that it is equal to that of the master engine. It will now be appreciated that the synchronizer 20 may be utilized to control the speed of an engine in accordance with a speed reference signal, whether the reference signal is derived from a master engine signal generator or any other source. This will now be described with reference to FIG. 11. The system in FIG. 11 comprises a speed reference generator 302 which suitably takes the form of electronic oscillator. It may be either a fixed frequency or an adjustable frequency oscillator and suitably generates a sinusoidal signal voltage. A first engine 310 is provided with a synchronizer 20' in accordance with the description given above. The speed reference signal from the generator 302 is supplied as a master signal to one speed signal input of the synchronizer 20'. The engine 310 is provided with a seed signal generator 304 and the engine speed signal developed thereby is applied as the slave engine signal to the other speed signal input of the synchronizer 20'. The throttle lever 306 of the engine 310 is connected through a push-pull cable 308 to the servo control lever 74 of the synchronizer 20'. As shown in FIG. 11, another engine 312, if desired, may be connected for speed control in the same manner as engine 310. For this purpose, it is provided with a synchronizer 20'' and the connections are made the same as described with reference to engine 310. In operation, the synchronizers 20' and 20'' will control the throttle levers of the engines 310 and 312, respectively to maintain the speed of each engine equal to a predetermined value which is proportional to the frequency of the speed reference signal produced by the generator 302. The relationship between the engine speed and the signal frequency is preselected by the setting of the switches in the divide-by-n circuit 272 and the setting of the dip switches 274 as described with reference to the controller circuit of FIG. 10. If desired, a third engine (not shown) may be operated as a slave engine in synchronism with either engine 310 or 312 by providing the third engine with its own synchronizer in an arrangement just the same as the first illustrative embodiment described above.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A synchronizer for controlling the speed of a slave engine in accordance with the speed of a master engine, said synchronizer comprising:

adjustable speed control means for adjusting the speed of the slave engine, a master engine speed signal generator for generating an electrical master speed signal, a slave engine speed signal generator for generating an electrical slave speed signal, circuit means coupled with said signal generators for producing a correction signal corresponding to the difference between the engine speeds, a movable manual actuator for adjusting said adjustable speed control means, a servo actuator coupled with said circuit means and being movable in response to said correction signal for adjusting said adjustable speed control means, transfer means for selectively transmitting movement of said manual actuator or said servo actuator to said adjustable speed control means, selector means for selecting which of said actuators transmits movement to said adjustable speed control means, and means for holding said manual actuator in a predetermined throttle position when said servo actuator is selected and means for holding said servo actuator in a predetermined throttle position when said manual actuator is selected.

2. The synchronizer defined by claim 1 wherein said transfer means comprises:

first and second members mounted for rotation about an axis and coupled together for concurrent movement by a torsion spring, said first member being connected with said manual actuator, said second member being connected on one side of its rotation axis to said servo actuator and being connected on the other side of its rotation axis to said adjustable speed control means.

3. The synchronizer defined in claim 2 wherein said means for holding said manual actuator comprises:

means connected with said first member for immobilizing said first member whereby said second member may be rotated by said servo actuator independently of said first member.

4. A synchronizer for controlling the speed of an engine, said synchronizer comprising:

adjustable speed control means for adjusting the speed of the engine, a manual actuator, a servo actuator, transfer means for selectively transmitting movement of said manual actuator or said servo actuator to said adjustable speed control means, and selector means for selecting which of said actuators transmits movement to said adjustable speed control means, and means for holding said manual actuator in a predetermined throttle position when said servo actuator is selected and means for holding said servo actuator in a predetermined throttle position when said manual actuator is selected.

* * * * *

UNITED STATES PATENT AND TRADEMARK OFFICE

CERTIFICATE OF CORRECTION

PATENT NO. : 4,964,276

DATED : October 23, 1990

INVENTOR(S) : Sturdy, H. D.

It is certified that error appears in the above-identified patent and that said Letters Patent is hereby corrected as shown below:

Column 2, line 30, delete "16," and insert --16'--.

Line 32, delete "16," and insert --16'--.

Line 36, delete "14," and insert --14'--.

Column 6, line 13, delete "than" and insert -- then --.

Signed and Sealed this

Sixteenth Day of February, 1993

*Attest:*

STEPHEN G. KUNIN

*Attesting Officer*

*Acting Commissioner of Patents and Trademarks*